US005394573A

United States Patent [19]

Laughlin et al.

[11] Patent Number: 5,394,573

[45] Date of Patent: Mar. 7, 1995

[54] UPHOLSTERED SOFA BED

[75] Inventors: Glenn M. Laughlin, High Point, N.C.; Frank Jeffrey A., Arlington, Va.; Bruce Hirschhaut, High Point, N.C.

[73] Assignee: JBG Original Designs Incorporated, High Point, N.C.

[21] Appl. No.: 45,539

[22] Filed: Apr. 12, 1993

[51] Int. Cl.[6] ..... A47C 17/04

[52] U.S. Cl. ..... 5/18.1; 5/47

[58] Field of Search ..... 5/18.1, 47

[56] References Cited

U.S. PATENT DOCUMENTS

| | | | |
|---|---|---|---|
| Re. 23,955 | 3/1955 | Green | 5/47 |
| 638,466 | 12/1899 | Kelly | 5/47 |
| 813,233 | 2/1906 | Padmore | 5/47 |
| 1,366,820 | 1/1921 | Minnick . | |
| 2,621,337 | 12/1952 | Karpen | 5/47 |
| 2,628,367 | 2/1953 | Green | 5/47 |
| 2,738,520 | 3/1956 | Murphy et al. | 5/47 |
| 3,083,496 | 4/1963 | Feinerman . | |
| 3,129,472 | 4/1964 | Hensel . | |
| 3,201,805 | 8/1965 | Smith . | |
| 3,248,147 | 4/1966 | Testa . | |
| 3,311,408 | 3/1967 | Sarvas . | |
| 3,357,030 | 12/1967 | George | 5/18.1 |
| 3,658,382 | 4/1972 | Anderson . | |
| 3,695,690 | 10/1972 | Carson . | |
| 3,774,966 | 11/1973 | Faulkner et al. . | |
| 3,799,611 | 3/1974 | Steinfeld . | |
| 3,842,456 | 10/1974 | Bronstien, Jr. . | |
| 3,871,041 | 3/1975 | Plume . | |
| 3,951,558 | 4/1976 | Komarov . | |
| 3,966,340 | 6/1976 | Morris . | |
| 4,012,155 | 3/1977 | Morris . | |
| 4,025,216 | 5/1977 | Hives . | |
| 4,165,902 | 8/1979 | Ehrlich . | |
| 4,204,287 | 5/1980 | Lane et al. . | |
| 4,261,667 | 4/1981 | Ervin et al. . | |
| 4,292,003 | 9/1981 | Pond . | |
| 4,305,616 | 12/1981 | Martinez . | |
| 4,365,840 | 12/1982 | Kehl et al. . | |
| 4,668,011 | 5/1987 | Fister, Jr. . | |
| 4,691,965 | 9/1987 | Hsiung . | |
| 4,711,495 | 12/1987 | Magder . | |
| 4,883,331 | 11/1989 | Mengel . | |
| 4,886,326 | 12/1989 | Kuzyk . | |
| 4,893,958 | 1/1990 | Wieland . | |
| 4,932,720 | 6/1990 | Sherman . | |
| 4,944,627 | 7/1990 | Durney . | |
| 5,007,681 | 4/1991 | Meier et al. . | |
| 5,069,506 | 12/1991 | Wieland . | |
| 5,080,438 | 1/1992 | Moyer . | |
| 5,135,284 | 8/1992 | Crum . | |
| 5,265,939 | 11/1993 | Self et al. . | |

OTHER PUBLICATIONS

"RTA upholstery company offers style alternatives," Kunkel, Sep./Oct. 90 Upholstering Today, pp. 13–14.

Flotura Sleeper Fixture With Universal Mounting Plate, 1979.

Mounting Dimensions Model 900 Sleeper, 1979.

*Primary Examiner*—Michael J. Milano

*Attorney, Agent, or Firm*—Spencer, Frank & Schneider

[57] ABSTRACT

An upholstered sofa bed for mounting on a substantially horizontal surface comprising a frame member including right and left spaced vertical arm frame sections each having side support members, a back frame section interposed between the right and left frame sections, and a front frame section interposed between the right and left arm frame sections. A platform member is provided which includes a front platform section having at least one support leg retractably attached thereto, and a back platform section. A hinge member rotatably attaches the front platform section to the back platform section thereby permitting the platform member to be selectively placed in either a first position in which the surface of the back platform section makes an obtuse angle with the surface of the front platform section of the platform member and is supported by the back frame section and the front section of the platform member is supported by the side support member of the arm frame sections of said frame member; or in a second position in which the back platform section is supported in a horizontal position by the side support members and the front platform section is supported by the front frame section and the support leg.

9 Claims, 6 Drawing Sheets

UPHOLSTERED SOFA BED

BACKGROUND OF THE INVENTION

This invention relates to upholstered furniture having interchangeable components. In particular, it relates to an upholstered sofa bed that can be used as either a sofa or a bed.

In conventional upholstered sofa beds and sleep sofas, the standard method of construction utilizes a wood or woodproduct frame having a seat, a front rail, a back rail, two arms and a non-removable sleeper mechanism and mattress. Conventional upholstered sofa beds do not have interchangeable components and cannot be assembled or disassembled by the customer. Alternatively, "jack-knife" sofa beds utilize an upholstered seat and back connected by a metal hinge mechanism that allows the back to fold down into a single size bed. There are also "futon type" sofa beds that utilize hinged wooden frames that slide on a wood track into the open "sleep" position.

"Jackknife" and "futon style" sofa beds can usually be assembled and disassembled by the customer. In both cases, however, there are many drawbacks which are overcome by the present invention.

"Jackknife" sofa beds are usually constructed so that the seating and back sections are supported solely by bolts connected to the arms. The bolts normally loosen over time and must be continually retightened to maintain the structural integrity of the piece. In addition, the design of the "jackknife" mechanism requires that the seat remain stationary while the back folds straight down. This means that the sofa bed must be pulled away from the wall when converting from a sofa into a bed. Also, the seat and back sections are connected by the "jackknife" mechanism in such a manner that there is a gap between the cushions in the sleep position making the sofa bed relatively uncomfortable for sleeping.

"Futon style" sofa beds are generally sturdier and more comfortable than "jackknife" type sofa beds and have been widely accepted. The limitation of the "futon style," however is that the requisite tracks and slides needed to convert the frame from the seating position to the sleeping position typically restrict the styles to those that use bare wood frames without upholstering. In addition, assembly and disassembly requires the use of tools and far more time and effort than the present invention.

SUMMARY OF THE INVENTION

The present invention provides an item of upholstered furniture that can be easily converted from a comfortable seating sofa to a comfortable bed, and vice versa.

Another object of the invention is to provide an upholstered sofa bed that can be made with interchangeable parts which can be quickly and easily assembled and disassembled without tools.

A further object of the invention is to provide a sofa bed which does not need costly mechanical mechanisms or tracks and slides to convert between the sleeping and seating positions.

In accordance with the invention, an upholstered sofa bed is provided which comprises a frame member including a back frame section having right and left spaced vertical rails, top and bottom spaced horizontal rails interposed between the right and left rails, and at least one support cleat affixed to the bottom rail at a position intermediate the right and left rails. Right and left spaced vertical arm frame sections are also provided, each of which has back and front spaced vertical side rails, top and bottom spaced horizontal rails interposed between the back and front side rails, a side support affixed to the back and front vertical side rails, and a side support cleat affixed to the side support adjacent the back side rails. A front frame section is interposed between the front side rails of the right and left arm frame sections.

A platform member is provided which includes a front platform section having front and back spaced horizontal rails, and right and left spaced horizontal rails interposed between the front and back rails. Right and left legs are retractably attached to the right and left rails adjacent the front rail, the legs being movable between vertical and horizontal positions parallel to the right and left rails. At least one front platform section cleat is affixed to a lower surface of the front platform front rail, and right and left cleats are affixed to the lower surfaces of the right and left rails between the front and back rails.

A back platform section having front and back spaced horizontal back platform rails is also provided, this section having right and left spaced horizontal rails interposed between the front and back rails. The front rail of the back section is parallel to and adjacent the back rail of the front section.

A hinge section rotatably attaches the back rail of the front section of the platform member to the front rail of the back section of the platform member thereby permitting the platform member to be placed in either a first or second position. In the first position the surface of the back section of the platform member makes an obtuse angle with the surface of the front section of the platform member and is supported by the back frame section, and the right and left rails of the front section of the platform member are supported by the side supports of the arm frame sections of the frame member. In the second position, the right and left rails of the back section of the platform member are supported by the back section support cleat and the side support cleats of the back frame section, and the right and left rails of the front section of the platform members are supported by the front frame section and the right and left legs.

DESCRIPTION OF THE PREFERRED EMBODIMENT

Figure 1:
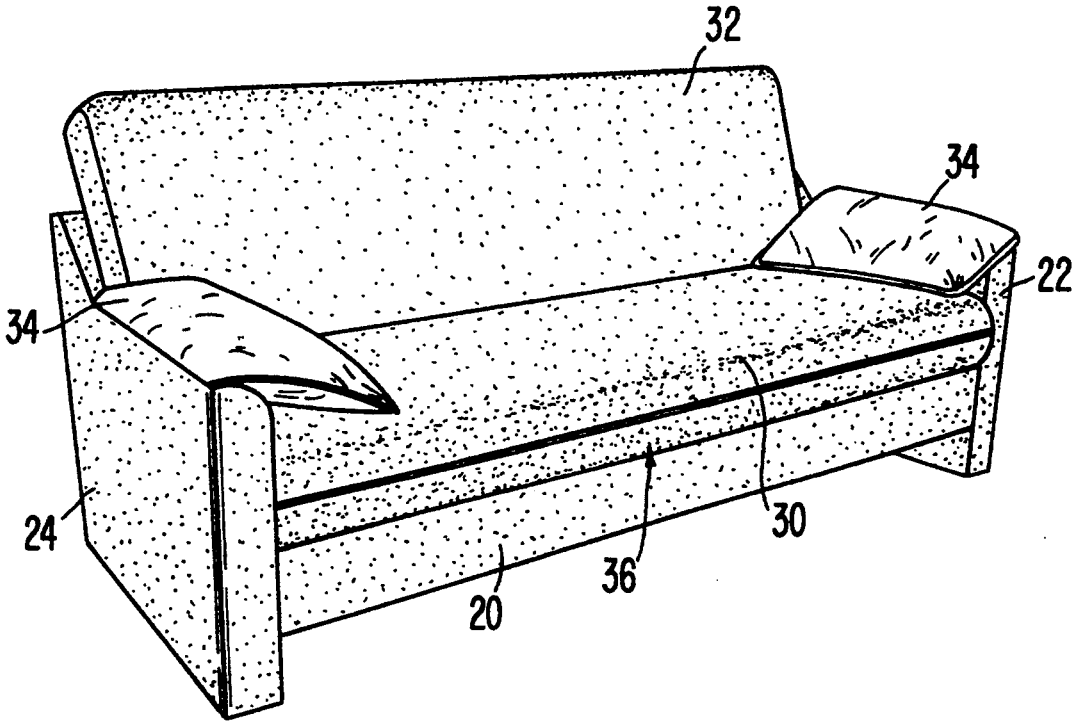
FIG. 1 is a perspective front view of an assembled sofa bed embodying the invention which is ready for use as a sofa.

The following description describes sofa beds embodying the invention, but it will be understood that it is equally applicable to chairs and other types of upholstered furniture. In the description, the terms "vertical" and "horizontal" refer to the directions substantially perpendicular and parallel respectively to a floor on which the sofa bed or other type of furniture is placed. Also, the described sofa bed is symmetrical; therefore, for clarity some of the drawing figures show only the right-hand components as viewed from the front of the sofa bed, the left-hand components being mirror images of the right-hand components. In general, the right hand components are identified by un-primed numbers and the left-hand components, whether illustrated or not, are identified by primed numbers.

Figure 5:
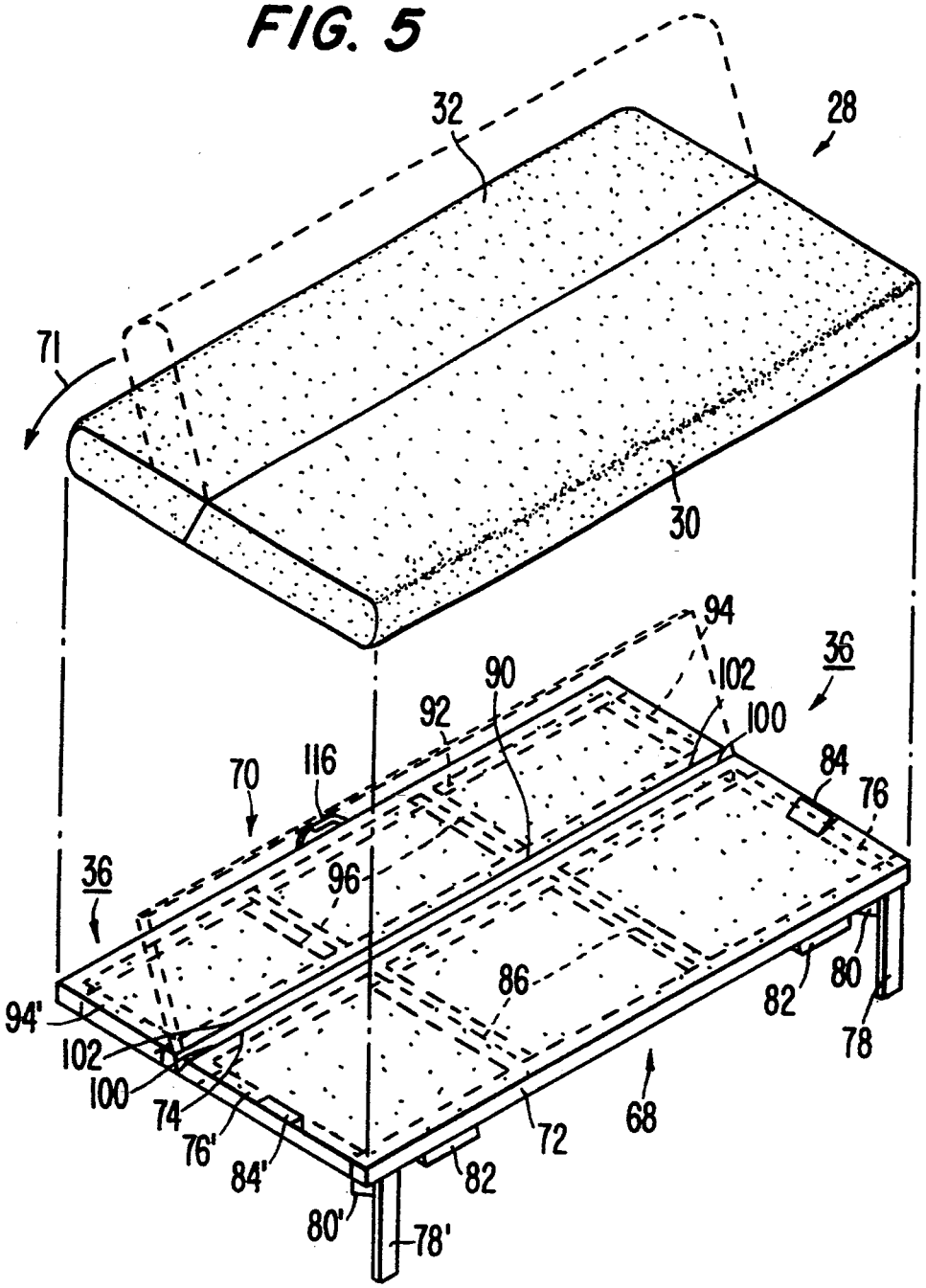
FIG. 5 is an exploded perspective view showing the platform and cushion members of the sofa bed.

FIG. 1 illustrates the assembled sofa bed of this invention when used as a sofa, as viewed from the front. The sofa bed comprises a frame member 18 (FIG. 3) which includes a vertical front section 20, right and left spaced vertical arm sections 22 and 24, and a back section 26 interposed between the arm sections 22 and 24. A cushion member 28 (FIG. 5) comprising a front cushion 30 and a back cushion 32 is provided, as are optional side cushions 34. The cushions 30 and 32 are supported by a platform member 36 (FIG. 5).

Figure 2:
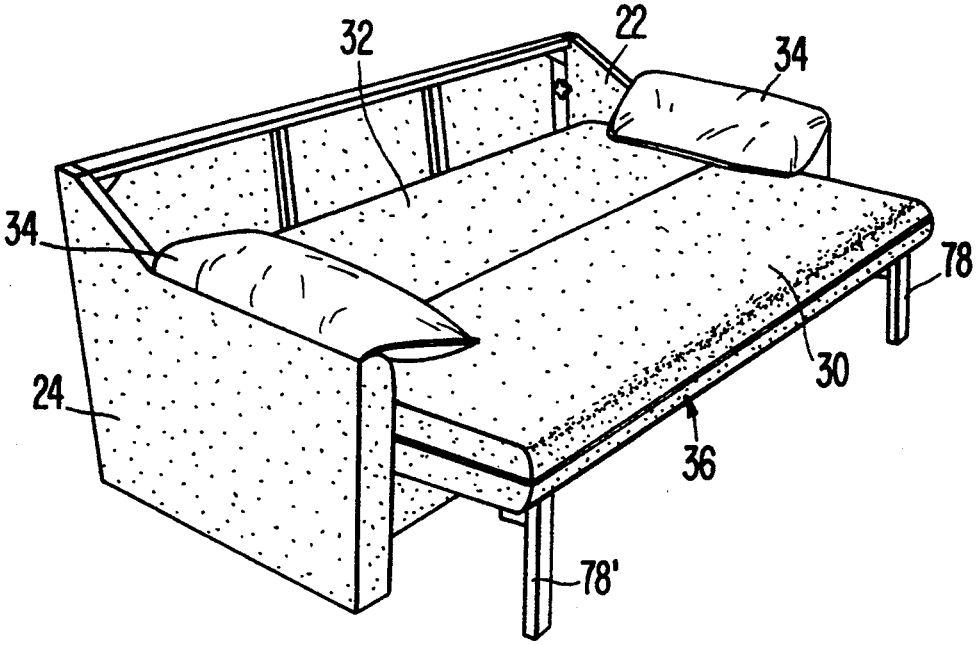
FIG. 2 is a perspective front view of the sofa bed of FIG. 1 ready for use as a bed.

FIG. 2 illustrates the assembled sofa bed when used as a bed. For use as a bed, a platform member 36 is extended so that front and back cushions 30, 32 are supported horizontally by the platform member, the front end of the platform member resting on retractable legs 78 and 78'.

Figure 3:
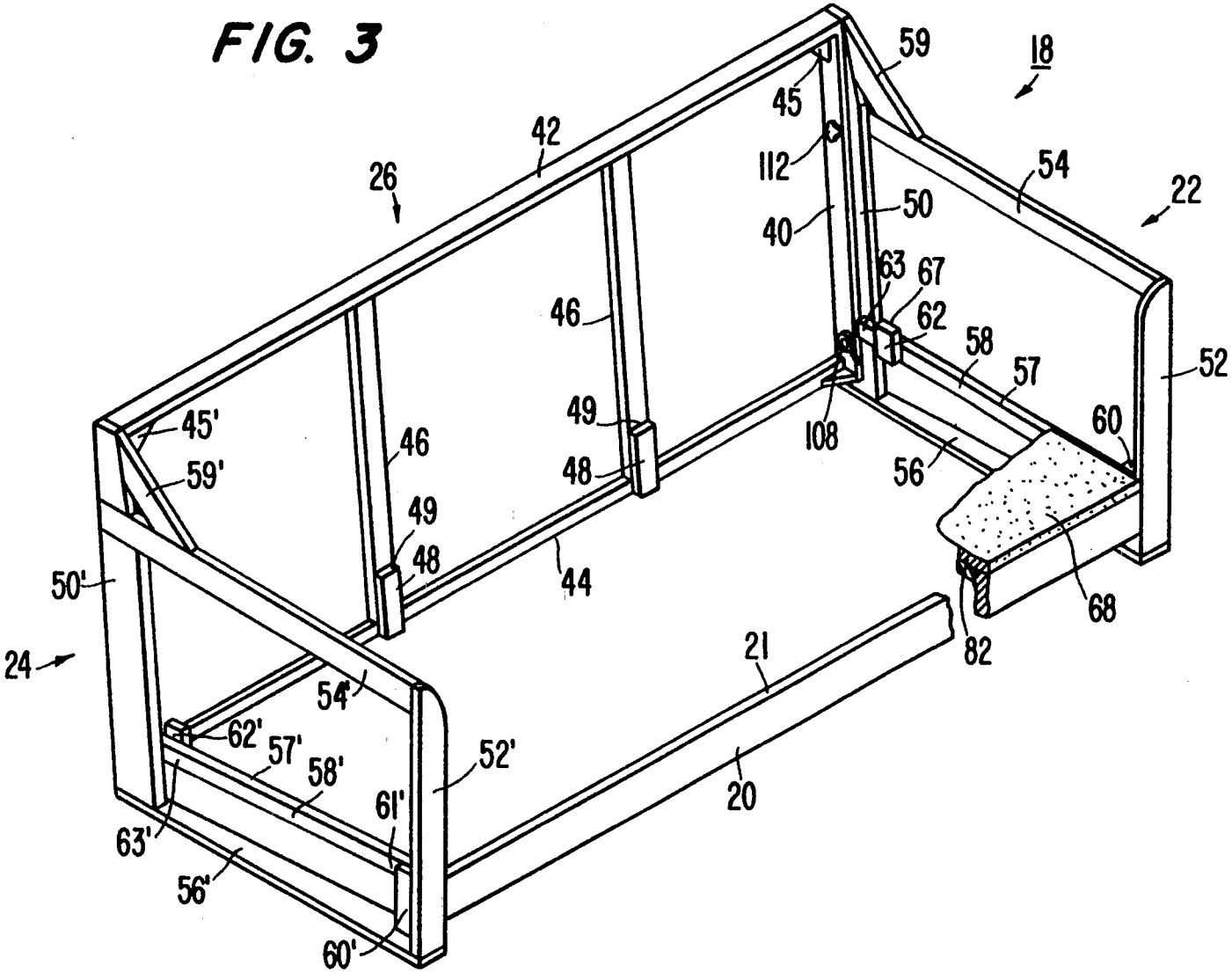
FIG. 3 is a perspective view of the frame member of the sofa bed.

As shown in FIG. 3, the back section 26 of frame member 18 includes right and left spaced vertical side rails 40, 40' and top and bottom spaced horizontal rails 42, 44 interposed between the side rails 40, 40'. Intermediate vertical rails 46 are interposed between the horizontal rails 42, 44, and back section support cleats 48 are attached to the lower portion of intermediate vertical rails 46 to support the platform member 36. Corner blocks 45, 45' provided between top rail 42 and vertical side rails 40, 40' support a back section 70 (FIG. 5) of platform member 36 when the sofa bed is used as a sofa, as shown in FIG. 1. Blocks 45 and 45' also supply additional rigidity to the back section 26 of frame member 18.

Figure 8:
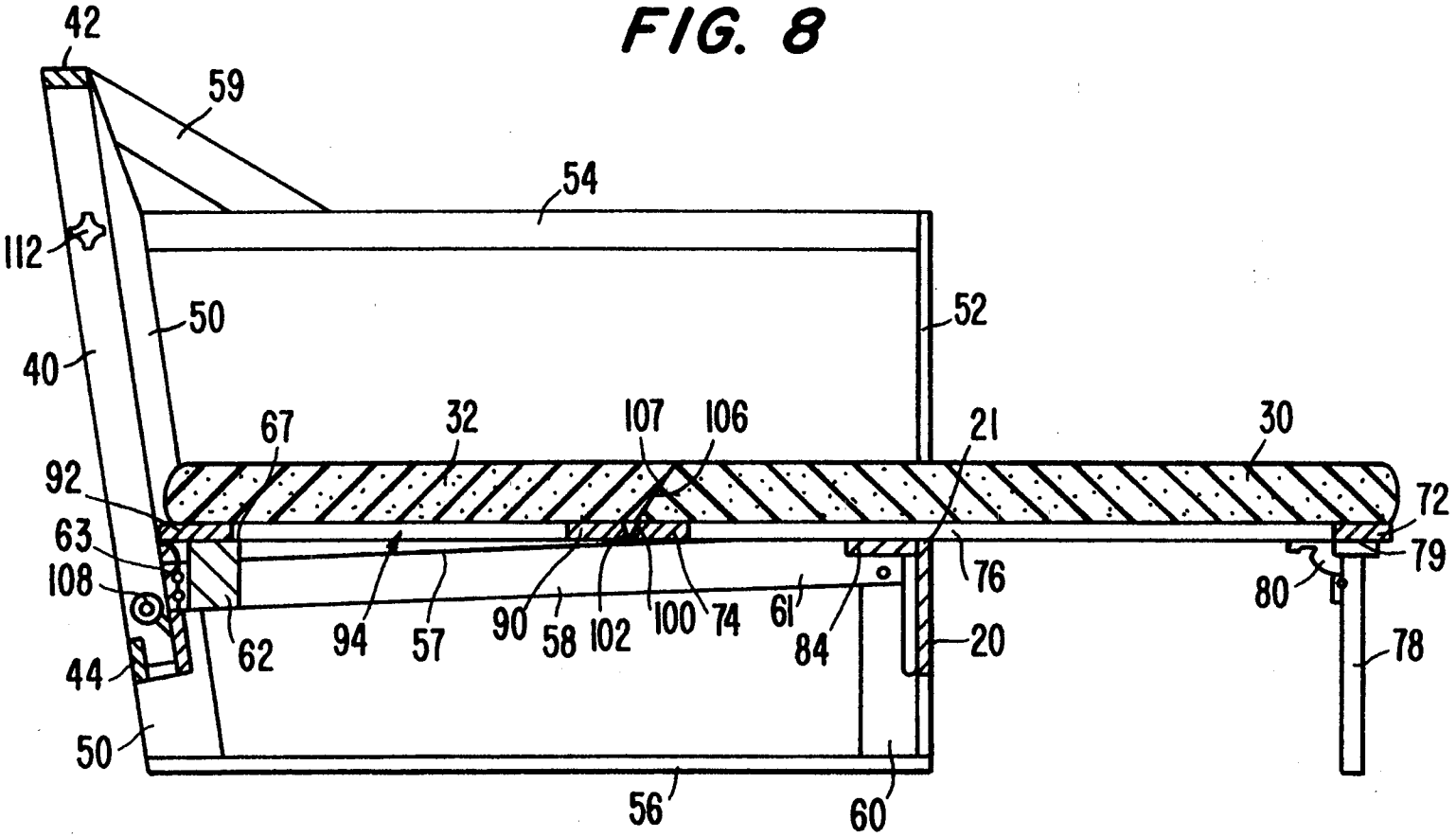
FIG. 8 illustrates the interior of the right arm section of the sofa bed with the platform member extended for use as a bed.

Each of the arm sections 22, 24 of the frame member 18 comprises back vertical side rails 50, 50' and front vertical side rails 52, 52', top horizontal rails 54, 54' and bottom horizontal rails 56, 56' being interposed between the back and front vertical side rails. A side support 58 is attached between the back side rail 50 and a front side support rail 60, and a side support 58' is attached between the back side rail 50' and a front side support rail 60'. The top surfaces 57, 57' of side supports 58, 58' slope downwards with respect to a horizontal plane parallel to the floor from front ends 61, 61' of side supports 58, 58' to side support cleats 62, 62'. Side support cleats 62, 62' are affixed to side supports 58, 58' adjacent the back section 26 to provide support for the platform member 36 when used in the extended position for sleeping, as shown in FIGS. 2 and 8, and also to prevent front-to-back movement of platform 36 when the sofa bed is used as a bed. Diagonal support elements 59, 59' are provided to supply additional rigidity to arm sections 22 and 24.

Figure 4:
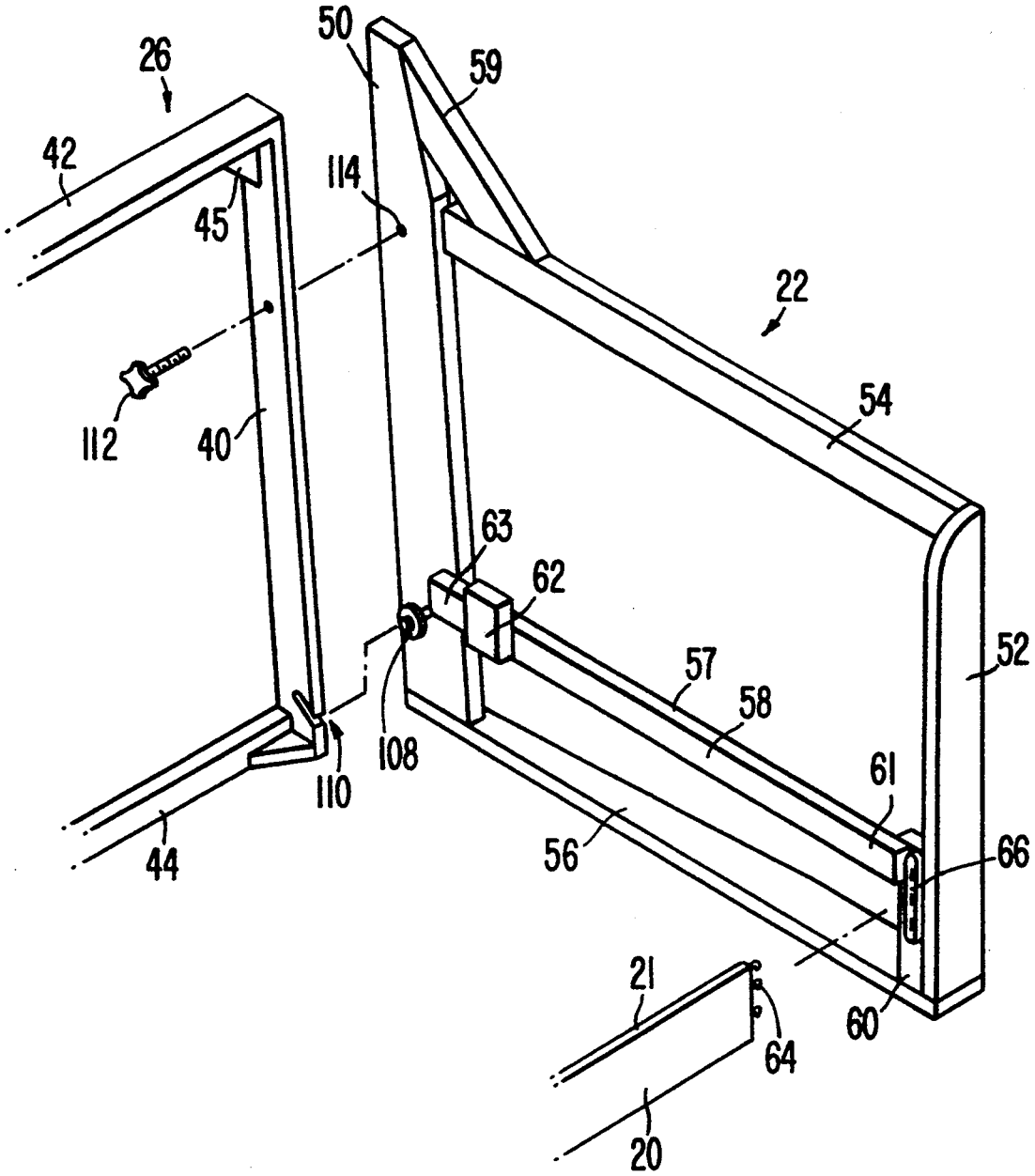
FIG. 4 is a partial perspective view of the back and right arm sections of the sofa bed showing how they are attached.

The front section 20 is removably attached to the front side support rails 60, 60' by conventional three-pronged stamped metal fasteners known as bed hooks. Referring to FIG. 4, One half 64 of a bed hook is secured to an end of the front section 20 and the other half 66 is routed into or surface mounted onto the front side support rail 60. Identical bed hooks are attached to the other end of the front section 20 and to the front side support rail 60'. The bed hooks permit the front section 20 to be easily attached and detached from the arm sections 22 and 24.

Figure 7:
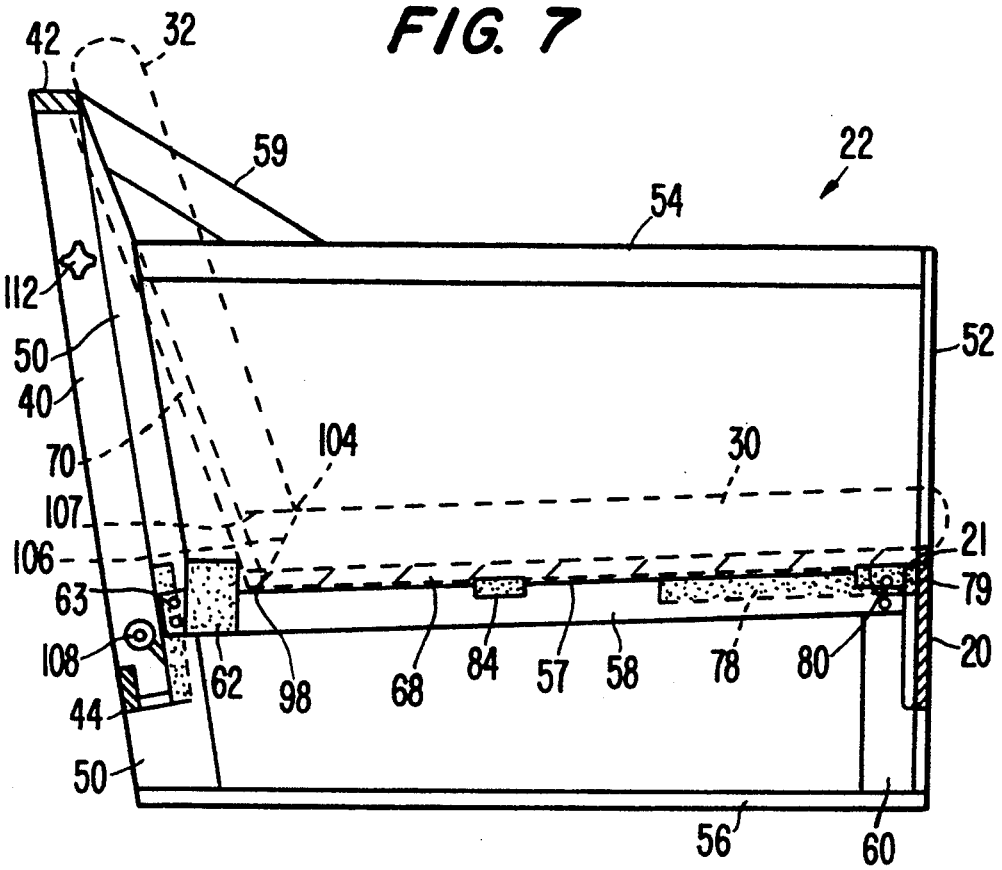
FIG. 7 illustrates the interior of the right arm section of the sofa bed with the platform member retracted for use as a sofa.
Figure 9:
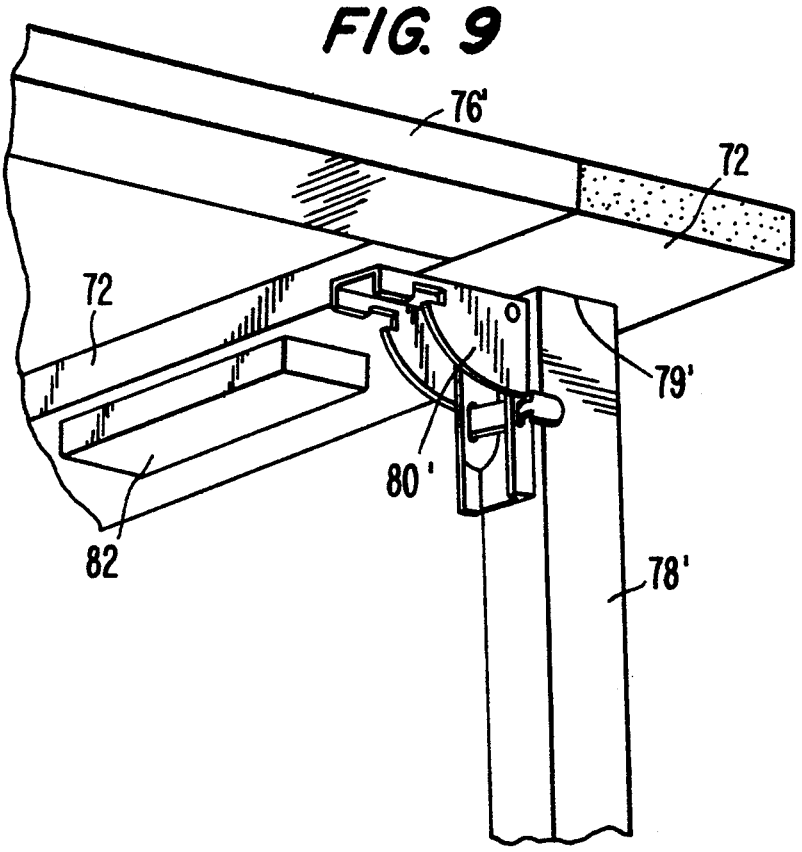
FIG. 9 is a partial perspective view showing the left front corner of the platform member.

Referring to FIG. 5, the platform member 36 comprises a front platform section 68 and a back platform section 70. The front platform section 68 includes front and back horizontal rails 72 and 74, and right and left horizontal rails 76 and 76' interposed between the front and back rails 72 and 74. Right and left legs 78, 78' are retractably attached to the lower surface of front rail 72 of the front platform section 68 adjacent to the right and left horizontal rails 76, 76' by conventional positive locking hinges 80 and 80', as best illustrated in FIGS. 7 and 9. Front cleats 82 (FIG. 9) are attached to the lower surface of front horizontal rail 72, and right and left side cleats 84, 84' are attached to the lower surface of the right and left rails 76, 76' between the front and back horizontal rails 72, 74. When used as a sofa, front cleats 82 contact the back side of front section 20 to prevent back-to-front sliding of the platform member 36.

Intermediate support rails 86 are interposed between the front and back rails 72 and 74 of the front platform section 68 for additional rigidity, and optional springs or webbing may be installed in the spaces between the rails of the front platform section.

The back platform section 70 includes front and back horizontal rails 90 and 92, and right and left horizontal rails 94 and 94' are interposed between the front and back rails 90 and 92. Intermediate support rails 96 are interposed between the front and back rails 90 and 92 of the back platform section 70 for additional rigidity, and optional springs or webbing may be installed in the spaces between the rails of the back platform section.

Figure 6:
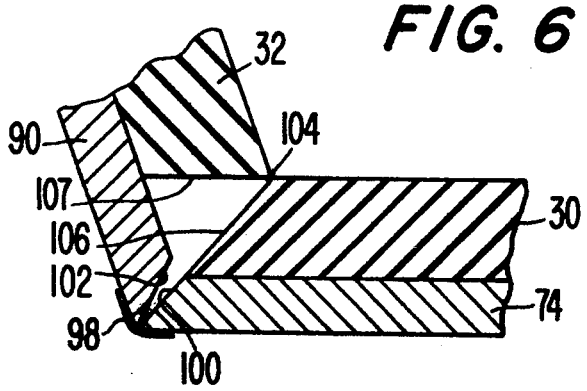
FIG. 6 is a sectional view showing the front and back sections of the frame member attached by means of a hinge.

Referring to FIGS. 5 and 6, an elastic webbing hinge member 98 rotatably attaches the front platform section 68 to the back platform section 70. Hinge 98 extends along the back rail 74 of the front platform section 68 and the front rail 90 of the back platform section 70, and is fastened thereto to permit the back platform section 70 to be rotated in the direction of arrow 71 from a first position in which it makes an obtuse angle with respect to the front platform to a second position in which it is parallel to the front platform section 68. In the first position, the sofa bed is used as a sofa as shown in FIGS. 1 and 7, and by the dashed lines in FIG. 5. In the second position, the sofa bed is used as a bed as shown in FIGS. 2 and 8. For shipping or storage, hinge 98 permits the back platform section 70 to be rotated in the direction of arrow 71 about a horizontal axis with respect to the front platform section 68 until it is in a third position in which the bottom surface of the back platform section 70 is in contact with the bottom surface of the front platform section 68 and is parallel thereto. This position requires a minimum of shipping and storage space.

FIG. 6 shows the platform 36 in a position midway between the seating and sleeping positions. As shown, the rear edge 100 of the back rail 74 of the front platform section 68 makes an acute angle with the front edge 102 of the front rail 90 of the rear platform section 70. When the sofa bed is being used as a sofa, this angle is approximately zero degrees, the front cleats 82 contact the back of front section 20 (FIG. 9) to prevent back-to-front movement of the platform member.

The front cushion portion 30 of the seat cushion 28 is attached to and supported by the front platform section 68 and the rear cushion portion 32 rests against and is supported by the back platform section 70. Optionally, a hinge 104 may be placed between the back edge 106 of the front cushion portion 30 and the front edge 108 of the back cushion portion 32 to maintain the front and back cushion portions 30, 32 connected to each other. Also, back cushion portion 32 may be attached to back platform section 70.

As shown in FIG. 4, the back member 26 is removably attached to the vertical arm members 22, 24 by sliding slots 110, 110' of first and second side members 40, 40' over the shanks of bolts 108, 108'. Thumbscrews 112, 112' are then hand tightened into threaded inserts 114, 114'. The frame assembly is completed by attaching bed hook halves 64, 64' of front section 20 to bed hook halves 66, 66' of arm sections 22, 24.

FIG. 7 illustrates the assembled sofa bed when used as a sofa, as viewed from the side. The front cushion 30 is supported by front platform section 68 which rests on top of front section 20 and surfaces 57, 57' of side support rails 58, 58'. Front platform section 68 is attached to back platform section 70 by the hinge 98. The back rail 92 of back platform section 70 rests below top rail 42 of back section 26 in contact with corner blocks 45, 45' and intermediate vertical rails 46 of back section 26 (FIG. 3). The front edge 102 of front rail 90 of back platform section 70 touches and rests on the rear edge 100 of back rail 74 of platform section 68.

FIG. 8 illustrates the assembled sofa bed when used as a bed, as viewed from the side. The back rail 92 of back platform section 70 rests on top surfaces 67, 67' of side support cleat 62, 62' and also top surfaces 49 of back support cleats 48 (FIG. 3). The front rail 72 of front platform section 68 rests on top surfaces 79, 79' of legs 78, 78'. The right and left front platform rails 76, 76' of front platform 68 rest on top surface 21 of front section 20. Top surfaces 49, 62, 62', 21, 79 and 79' are all approximately the same height so as to keep the platform 36 and cushion member 28 as level as possible. In the bed position (FIG. 8) the front edge 107 of back cushion 32 and the back edge 106 of front cushion 30 abut at an angle approximating 45°. This angle reinforces the cushions and eliminates an uncomfortable gap between the cushions that would be felt if the edges were cut at a 90° angle.

To convert the sofa bed from the seating position to the sleeping position, the cushion 30 and platform 68 are lifted so that front cleats 82 are lifted over the front section 20. Next, back cushion 32 is folded forward, exposing back platform section 70 and platform handle 116 (FIG. 5). Platform handle 116 is then pulled towards the front of the sofa bed and pushed down so that cushion 30 and attached platform 68 are forced forward until right and left side cleats 84, 84' are in contact with the back side of front section 20. Back cushion 32 is pushed back to rest on back platform section 70. The final step is to open legs 78, 78' into the vertical position, as shown in FIG. 9.

While the present invention has been described in detail with respect to preferred embodiments, it will be understood that numerous modifications, changes, variations and equivalents may be made by those skilled in the art without departing from the spirit and scope of the invention. Accordingly, it is intended that the invention herein be limited only by the scope of the appended claims.

What is claimed:

1. An upholstered sofa bed for mounting on a substantially horizontal surface, comprising a frame member including a back frame section having right and left spaced back frame section vertical side rails;

top and bottom spaced back frame section horizontal rails interposed between said right and left back frame section vertical side rails; and at least one back frame section support cleat affixed to said bottom back frame section horizontal rail at a position intermediate said right and left back frame section vertical side rails;

right and left spaced vertical arm frame sections, each of said arm frame sections having back and front spaced vertical arm frame section side rails;

top and bottom spaced horizontal arm frame section rails interposed between said back and front arm frame section side rails;

a side support affixed to said back and front vertical arm frame section side rails; and a side support cleat affixed to said side support arm frame section side rails;

a front frame section interposed between the front side rails of said right and left arm frame sections; and a platform member including a front platform section having front and back spaced horizontal front platform rails;

right and left spaced horizontal front platform rails interposed between said front platform front and back rails;

right and left legs retractably attached to said right and left front platform rails adjacent said front platform front rail, said legs being movable between a vertical position and a horizontal position parallel to said front platform right and left rails;

at least one front platform section cleat affixed to a lower surface of said front platform front rail; and right and left cleats affixed to lower surfaces of said right and left front platform rails between said front and back front platform rails; and a back platform section having front and back spaced horizontal back platform rails; and right and left spaced horizontal back platform rails interposed between said back platform front and back rails, the front rail of said back platform section being parallel to and adjacent the back rail of said front platform section; and a hinge member rotatably attaching the back rail of the front section of said platform member to the front rail of the back section of said platform member thereby permitting said platform member to be placed in (a) a first position wherein a surface of the back section of said platform member makes an obtuse angle with a surface of the front section of said platform member and is supported by said back frame section, and the right and left rails of the front section of said platform member are supported by the side supports of the arm frame sections of said frame member; or (b) a second position wherein the right and left rails of the back section of said platform member are supported by the back section support cleat of said back frame section and the side support cleats of said vertical arm sections, and the right and left rails of the front platform section of said platform member are supported by said front frame section and said right and left legs.

2. An upholstered furniture system as defined by claim 1 which further comprises a cushion member having front and rear cushion portions, the front and rear cushion portions being supported by the front and back sections of said frame member.

3. An upholstered furniture system as defined by claim 1 wherein the back and front sections of said frame member are detachably attached to said right and left arm sections.

4. An upholstered furniture system for mounting on a substantially horizontal surface, comprising:

a frame member including:

right and left spaced vertical arm frame sections, each of said arm frame sections having side support means;

back and front spaced vertical arm frame section side rails;

top and bottom spaced horizontal arm frame section rails interposed between said back and front arm frame section side rails, said side support means being affixed to said back and front vertical arm frame section side rails; and a side support cleat affixed to said side support means;

a back frame section interposed between the right and left frame sections; and a front frame section interposed between the right and left arm frame sections; and a platform member including:

a front platform section having at least one support leg retractably attached thereto, said leg being selectively movable between a vertical position and a horizontal position;

a back platform section; and a hinge member rotatably attaching the front platform section of said platform member to the back platform section of said platform member thereby permitting said platform member to be selectively placed in:

(a) a first position wherein a surface of the back platform section of said platform member makes an obtuse angle with a surface of the front platform section of said platform member and is supported by said back frame section, and the front section of said platform member is supported by the side support means of the arm frame sections of said frame member; or (b) a second position wherein the back platform section of said platform member is supported in a horizontal position by said side support means and the front platform section of said platform member is supported by said front frame section and said at least one leg.

5. An upholstered furniture system as defined by claim 4 wherein said front platform section further comprises front and back spaced horizontal front platform rails;

right and left spaced horizontal front platform rails interposed between said front platform front and back rails;

at least one front platform section cleat affixed to a lower surface of said front platform front rail; and right and left cleats affixed to lower surfaces of said right and left front platform rails between said front and back front platform rails.

6. An upholstered furniture system as defined by claim 4 wherein said back platform section comprises front and back spaced horizontal back platform rails; and right and left spaced horizontal back platform rails interposed between said back platform front and back rails, the front rail of said back platform section being parallel to and adjacent the back rail of said front platform section.

7. An upholstered furniture system for mounting on a substantially horizontal surface, comprising:

a frame member including:

right and left spaced vertical arm frame sections, each of said arm frame sections having side support means;

a back frame section interposed between the right and left frame sections having right and left spaced back frame section vertical side rails;

top and bottom spaced back frame section horizontal rails interposed between said right and left back frame section vertical side rails; and at least one back frame section support cleat affixed to said bottom back frame section horizontal rail at a position intermediate said right and left back frame section vertical side rails;

a front frame section interposed between the right and left arm frame sections; and a platform member including:

a front platform section having at least one support leg retractably attached thereto, said leg being selectively movable between a vertical position and a horizontal position;

a back platform section; and a hinge member rotatably attaching the front platform section of said platform member to the back platform section of said platform member thereby permitting said platform member to be selectively placed in:

(a) a first position wherein a surface of the back platform section of said platform member makes an obtuse angle with a surface of the front platform section of said platform member and is supported by said back frame section, and the front section of said platform member is supported by the side support means of the arm frame sections of said frame member; or (b) a second position wherein the back platform section of said platform member is supported in a horizontal position by said side support means and the front platform section of said platform member is supported by said front frame section and said at least one leg.

8. An upholstered furniture system as defined by claim 7 wherein said front platform section further comprises front and back spaced horizontal front platform rails;

right and left spaced horizontal front platform rails interposed between said front platform front and back rails;

at least one front platform section cleat affixed to a lower surface of said front platform front rail; and right and left cleats affixed to lower surfaces of said right and left front platform rails between said front and back front platform rails.

9. An upholstered furniture system as defined by claim 7 wherein said back platform section comprises front and back spaced horizontal back platform rails; and right and left spaced horizontal back platform rails interposed between said back platform front and back rails, the front rail of said back platform section being parallel to and adjacent the back rail of said front platform section.

* * * * *